United States Patent [19]

Smolka

[11] 4,120,653

[45] Oct. 17, 1978

[54] METHOD OF MACHINE WASHING OF SOLID SOILED MATERIALS BY CONTACTING THE CIRCULATING WASH LIQUID WITH ORGANIC CATIONIC EXCHANGE RESINS

[75] Inventor: Heinz Smolka, Langenfeld, Fed. Rep. of Germany

[73] Assignee: Henkel Kommanditgesellschaft auf Aktien, Dusseldorf-Holthausen, Fed. Rep. of Germany

[21] Appl. No.: 847,792

[22] Filed: Nov. 2, 1977

[30] Foreign Application Priority Data

Nov. 12, 1976 [DE] Fed. Rep. of Germany ..... 2651793

[51] Int. Cl.[2] ..... B08B 3/00

[52] U.S. Cl. ..... 8/137; 68/13 A; 210/38 A; 252/179

[58] Field of Search ..... 8/137, 141; 252/179; 68/13 A; 210/24, 38 A

[56] References Cited

U.S. PATENT DOCUMENTS

| | | | |
|---|---|---|---|
| 3,023,132 | 2/1962 | Diamond et al. | 8/137 |
| 3,937,042 | 2/1976 | Loeb | 68/13 A |
| 4,025,427 | 5/1977 | Loeb | 210/38 A |
| 4,066,394 | 1/1978 | Leonard | 8/137 |
| 4,071,377 | 1/1978 | Schwuger et al. | 252/179 |
| 4,072,621 | 2/1978 | Rose | 252/179 |

*Primary Examiner*—William E. Schulz
*Attorney, Agent, or Firm*—Hammond & Littell

[57] ABSTRACT

An improvement in the machine washing of solid soiled materials comprising withdrawing and recycling the tap water in contact with said solid soiled materials through a water-insoluble cation exchange polymer in particulate state having a swelled average particle diameter in excess of 20 $\mu$ and having a calcium binding power of at least 2 mVal per gram, said polymers being maintained out of contact with said solid soiled materials, for such time until the water has a hardness of not more than 70 mg CaO/liter, then adding other soluble washing and cleaning compounds to said softened tap water and washing said solid materials while continuing the recycling of the wash solution through said cation exchange polymer.

9 Claims, 7 Drawing Figures

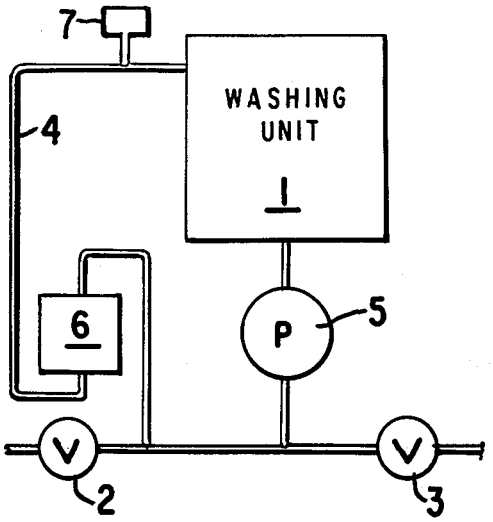
FIG. I
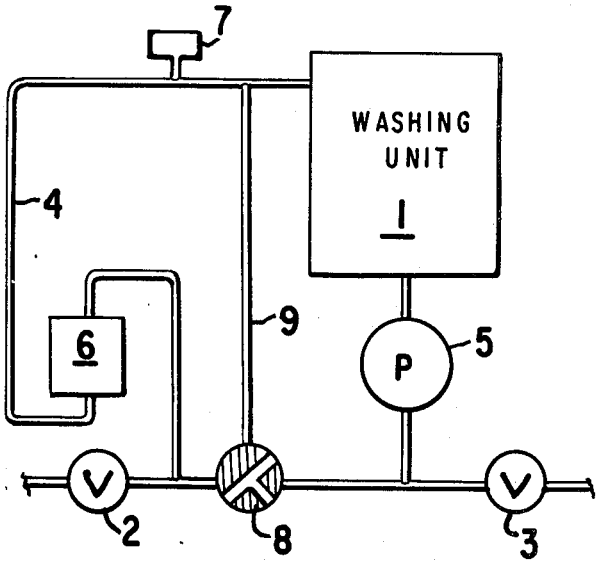
FIG. II
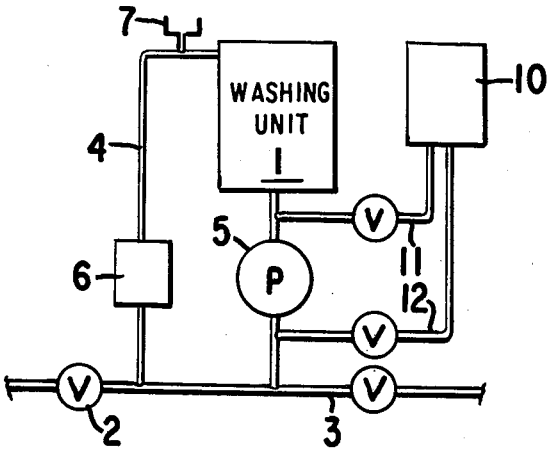
FIG. III
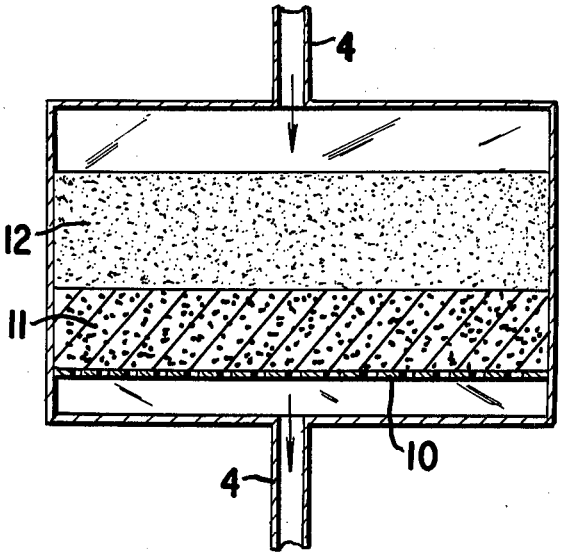
FIG. IV

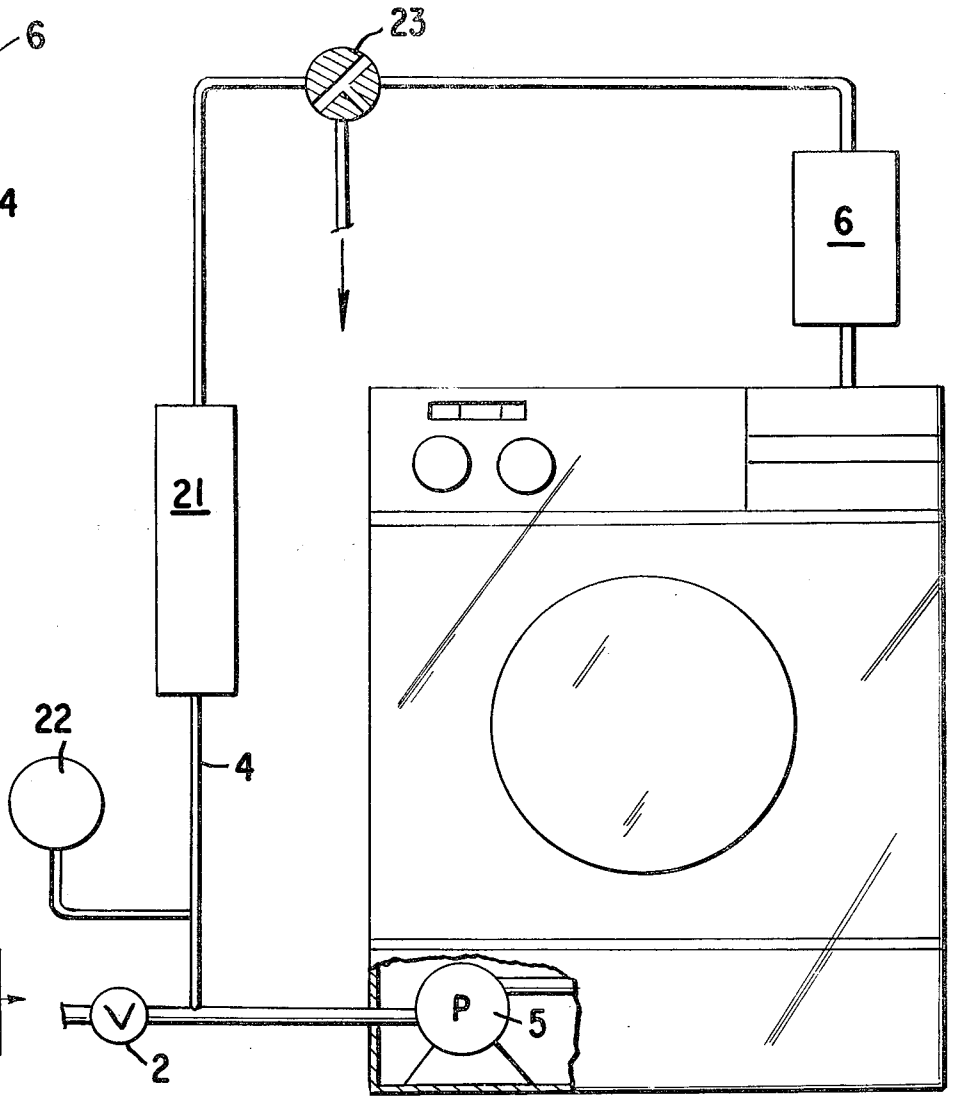
FIG. VI
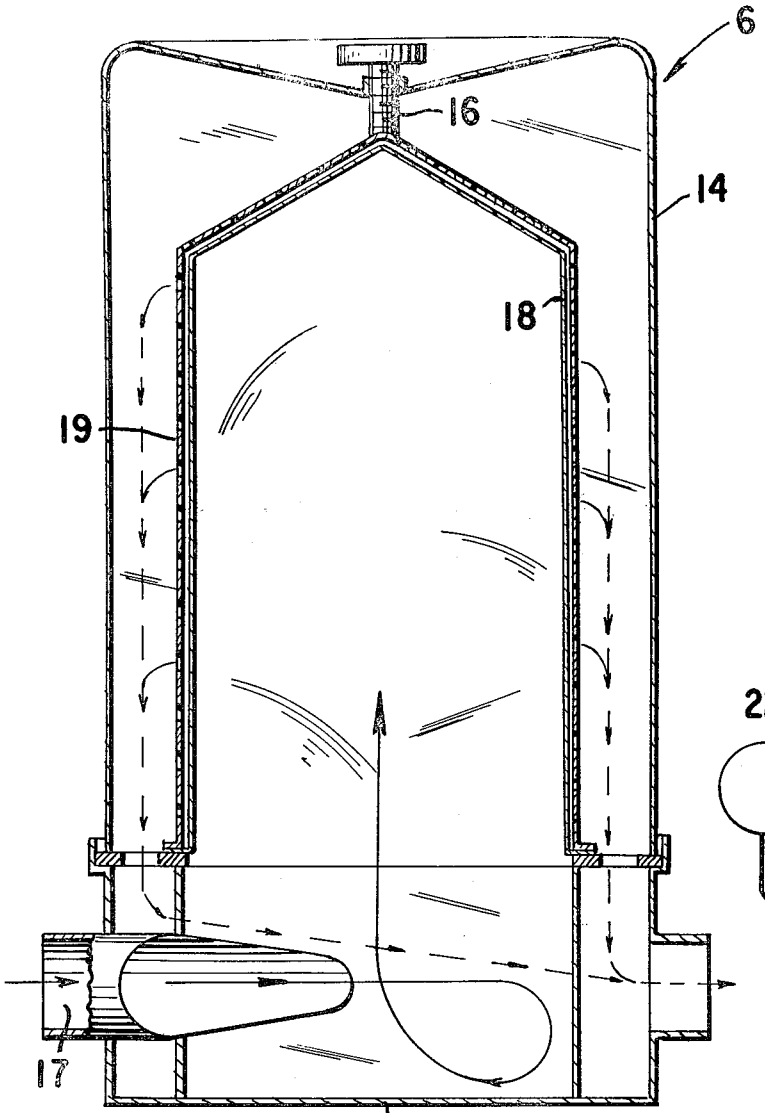
FIG. V

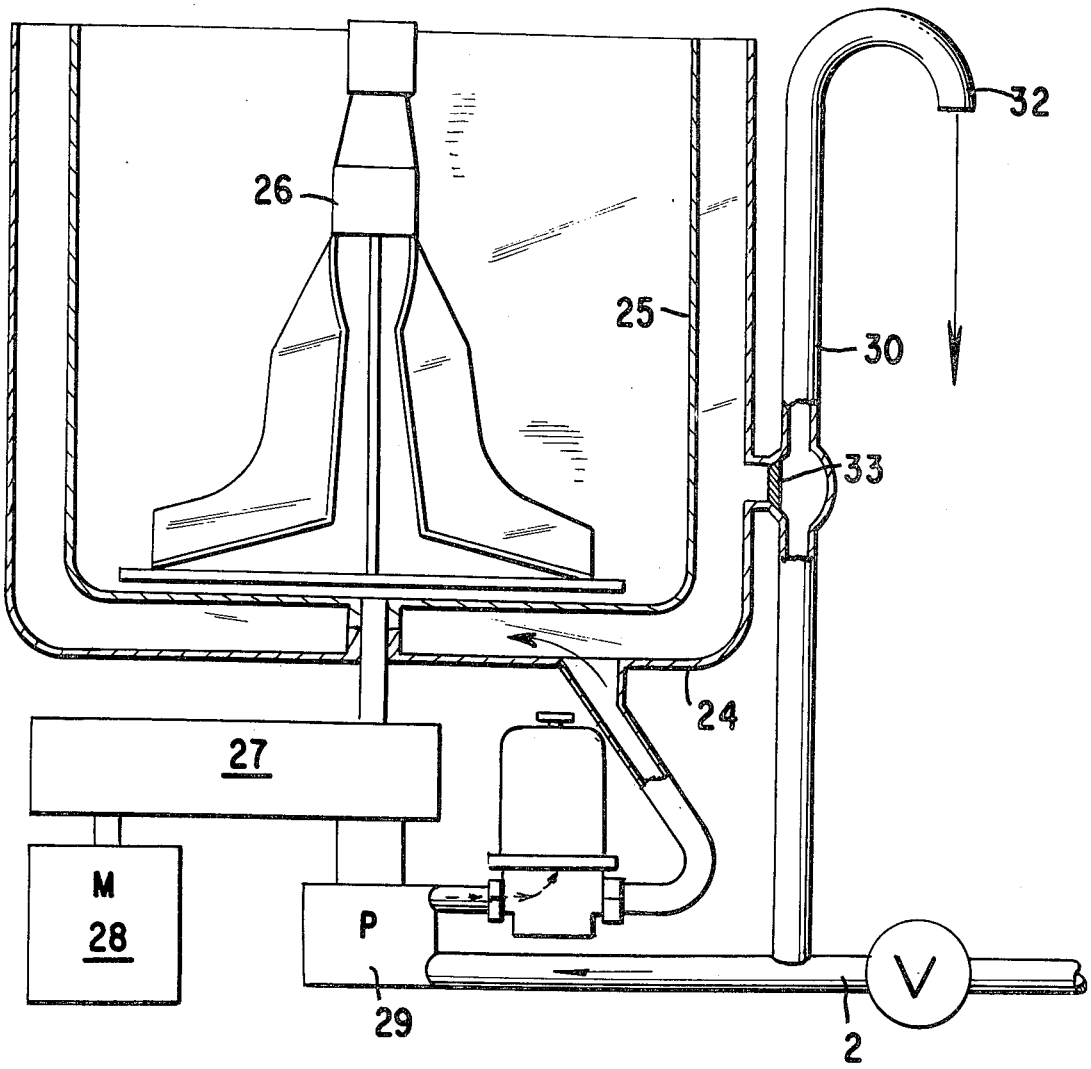
FIG. VII

METHOD OF MACHINE WASHING OF SOLID SOILED MATERIALS BY CONTACTING THE CIRCULATING WASH LIQUID WITH ORGANIC CATIONIC EXCHANGE RESINS

THE RELATED ART

Washing methods are known where the washing solution is circulated continuously during the washing process and conducted through one or more vessels in which the entrained dirt particles can settle from the wash water liquor before it is returned into the washing process. It has already been suggested to place screens or filters in the liquid circuit to retain coarse impurities or objects which could damage the mechanism. But since the bulk of the dirt is usually dissolved or dispersed in very finely divided form in the solution, the cleaning or regeneration of the solution is inadequate this way, and savings in certain washing and cleaning ingredients, for example, polymeric phosphates, cannot be achieved without a simultaneous decrease in the cleaning results.

In commercial laundries it is customary to prepare the washing solution with softened water, to which end the water to be used is furst treated with an ion-exchange compound (e.g., a zeolite). But soft water has not sufficient washing power, even in the presence of surface-active substances to clean textiles and dishes in the absence of builders.

The problem is particularly serious when the articles to be washed carry soil which contains hardness formers, as pre-treatment of the wash water does not affect the hardness thereby introduced. This results in progressive incrustation of the material being washed.

Furthermore it has been suggested to effect the washing process in the presence of ion-exchangers based on organic polymers, which are added to the washing solution either in the form of a textile or as granular or powdered resins. But textile-type ion-exchangers have only a relatively low ion-exchange capacity, so that large amounts of the ion-exchange textile are required. Almost any amount of hardness is detrimental to washing solutions which contain an anionic detergent, and in most areas where hardness is a significant problem, it is necessary to decrease the hardness of the water by at least 50%. The space occupied by the ion-exchanger is at the expense of the material to be cleaned. Granular or powdered ion-exchange agents become caught in fabrics or garments being washed unless special precautions are taken, and the particles are difficult to recover when the washing operation is completed. If, as has likewise been suggested, the ion-exchange resin is enclosed in a gauze bag to prevent the agent from depositing on the textile fibers, the cleaning effect of the washing solution is considerably decreased.

U.S. Pat. application Ser. No. 639,465, filed December 10, 1975, now abandoned in favor of its continuation Application Ser. No. 821,968, filed Aug. 4, 1977, disclosed a method of machine washing and cleaning of solid materials with the use of low-phosphate or phosphate-free washing and cleaning solutions in the presence of water-insoluble cation exchangers which are able to bind the hardness formers of the water and of the impurities, characterized in that the cation exchanger has a calcium binding capacity of at least 2 mVal/gm and consists of a copolymer or graft polymer of olefinically-unsaturated monocarboxylic acids and/or polycarboxyic acids where the wash liquor contains 0.05 to 2 gm/liter of water-soluble calcium ion-binding complex formers and where the wash liquid is passed continuously or intermittently through an adsorption device which is adapted to separate the cation exchanger from the wash liquid.

According to this application, the washing and cleaning process can be performed, for example, by first adding a sufficient amount of the cation exchanger into the adsorption device, charging the washing area with the soiled solid material to be washed, and then dissolving the washing or cleaning agent in the water charged where the cation exchanger is in the adsorption device, already before the addition of the material to be washed or cleaned, thereby excluding direct contact of the material to be cleaned with the insoluble ion-exchanger. The fresh water thus comes into contact first with the cleaning agent, before it comes in contact with the material to be cleaned and thereafter with the cation exchanger.

OBJECTS OF THE INVENTION

An object of the present invention is the development of a process for washing solid soiled materials employing larger particle sized aluminosilicates wherein an enhanced washing effect is had.

Another object of the present invention is the development of a method for machine washing and cleaning of solid materials utilizing washing and cleaning solutions in the presence of water-insoluble cation exchange agents which are capable of binding the hardness components of the water and the soil, comprising withdrawing and recycling the tap water having a hardness of more than 80 mg CaO/liter in contact with said solid soiled materials through a water-insoluble cation exchange copolymer in particulate state having a swelled average particle diameter in excess of 20$\mu$ and having a calcium binding power of at least 2 mVal/gm, said copolymer being a copolymer of graft polymer derived from mono-olefinically-unsaturated carboxylic acids, said cation exchange copolymer being maintained out of contact with said solid soiled materials in a separate area from the washing area, for such time until the water has a hardness of not more than 70 mg CaO/liter, then adding other soluble washing and cleaning compounds, including between 0.05 gm/liter and 2 gm/liter of a water-soluble calcium-binding sequestrant and customary surface-active compounds selected from the group consisting of an anionic surface-active compound, a nonionic surface-active compound and mixtures thereof, to said softened tap water and washing said solid materials while continuing the recycling of the wash solution through said cation exchange copolymer wherein the total amount of washing solution is continously or intermittently cyclically circulated from the washing area through the separate area with the cation exchange copolymer and then back to the washing area at least five times during the cleaning process, and where the amount of the cation exchange copolymer is so selected that the residual hardness of the filtered washing solution is less than 20 mg CaO/liter.

These and other objects of the present invention will become more apparent as the description thereof proceeds.

THE DRAWINGS

FIGS. I, II and III are flow diagrams of the processes according to the invention.

FIGS. IV and V show schematically in section a fixed bed and a fluid bed filter suitable for use in the process of the invention.

FIG. VI shows schematically an elevation of a machine washer useful for the process according to the present invention, and FIG. VII shows a vertical section of another machine washer useful for the process according to the present invention.

DESCRIPTION OF THE INVENTION

I have now found that the cleaning results as described in Ser. Nos. 639,465 and 821,968 can be further enhanced by proceeding in the manner described below. The subject of the invention is a method according to Ser. Nos. 639,465 and 821,968, characterized in that, before adding the other washing and cleaning compounds, the cleaning liquid is softened by means of the cation exchange copolymer introduced into the adsorption apparatus to a hardness of not more than 7° dH (70 mg CaO/liter), preferably less than 5° dH (50 mg CaO/liter).

By the "other washing and cleaning compounds" must be understood the various compounds mentioned in Ser. Nos. 639,465 and 821,968, as well as Ser. No. 458,306 and its continuation Ser. No. 800,308, such as calcium complexing and precipitation agents, surfactants, builders, bleaches as well as activators or stabilizers for such bleaches, soil suspension agents, enzymes as well as other additives normally contained in washing and cleaning agents.

More particularly, the present invention relates to a method for machine washing and cleaning of solid materials utilizing washing and cleaning solutions in the presence to water-insoluble cation exchange agents which are capable of binding the hardness components of the water and the soil, comprising withdrawing and recycling the tap water having a hardness of more than 80 mg CaO/liter in contact with said solid soiled materials through a water-insoluble cation exchange copolymer in particulate state having a swelled average particle diameter in excess of 20μ and having a calcium binding power of at least 2 mVal/gm, said copolymer being a copolymer or graft polymer derived from mono-olefinically-unsaturated carboxylic acids, said cation exchange copolymer being maintained out of contact with said solid soiled materials in a separate area from the washing area, for such time until the water has a hardness of not more than 70 mg CaO/liter, then adding other soluble washing and cleaning compounds, including between 0.05 gm/liter and 2 gm/liter of a water-soluble calcium-binding sequestrant and customary surface-active compounds selected from the group consisting of an anionic surface-active compound, a nonionic surface-active compound and mixtures thereof, to said softened tap water and washing said solid materials while continuing the recycling of the wash solution through said cation exchange copolymer, wherein the total amount of washing solution is continuously or intermittently cyclically circulated from the washing area through the separate area with the cation exchange copolymer and then back to the washing area at least five times during the cleaning process, and where the amount of the cation exchange copolymer is so selected that the residual hardness of the filtered washing solution is less than 20 mg CaO/liter.

The softening of the tap water wash liquid, which precedes the addition of washing and cleaning agent, can be done by contacting the fresh water flowing into the washer with the cation exchange copolymer or ion exchanger, for example, by putting the ion exchanger into the detergent charging device of a washing or dishwashing machine and collecting it in the adsorption device or on the filter by repeated recycling of the liquid prior to the addition of the soiled material. Alternatively, the liquid in contact with the soiled materials may be cycled through an ion exchanger already disposed in the adsorption device, this exchanger being present as powder, granulated material or also in the form of a filter plate or filter cartridge. Depending on the quantity and nature of the ion exchanger or, respectively, the hardness of the fresh water, generally one to five pumping cycles are required to obtain the desired initial hardness of the wash liquid. Alternatively, the fresh water may be passed directly from the tap through the ion exchanger, thereby partially softening it already during the filling and thereafter recycled from one to 20 cycles to obtain the desired initial hardness of the wash liquid.

During the preliminary softening, the substrate or soiled material, such as the textile material or the dishes to be cleaned, is already in the washing and cleaning apparatus which is agitated or sprayed, respectively, to contact the soiled material with the circulating softening water. The advantage of this is that superficially adhering, easily removable hardness formers are removed at the same time and fixed by the ion-exchanger. The tap water employed in the process should have a specific hardness which should be over 80 mg CaO/liter (8° dH) for the process of the invention to be of advantage. City water supplies with a hardness in excess of 150 mg CaO/liter are common. The "fresh water" may be part of the rinse water from the preceding washing operation, whereby an additional saving of water is achieved, particularly if the tap water is high in hardness.

After completed softening of the water to a hardness of not more than 7° dH, preferably less than 5° dH, and in particular less than 3° dH, the other washing and cleaning agent components or their mixtures are added and the process is carried out by circulating the wash liquor continuously or intermittently through the ion exchanger deposited or collected in the adsorption device, which does not come into direct contact with the material to be cleaned.

A cation exchange polymer having a mean particle size of more than 20μ is employed in the form of a bed. The water to be softened, then the washing solution is pumped through the bed continuously or intermittently as the washing proceeds where the ion exchanger is in a separate vessel restrained by a filter means. By this means the calcium hardness of the tap water can be decreased by more than 50% and the washing solution can be maintained at a negligibly low level of hardness. The bed may be a static bed composed of particles or agglomerated particles of the ion exchanger in a range of from 20μ to 250μ or higher, or the ion exchanger may be in the form of a solid, porous block, in which event, the block acts as a filter. The bed may be a fluidized bed, in which event, the cation exchange agent is present in divided form in aqueous suspension in a vessel apart from the objects being washed. The particles may be surrounded by a porous envelope or sleeve, which acts as a filter.

After the circulating water has been softened, the washing process proceeds with the introduction of the washing and cleaning agent. The method is characterized in that the washing solution has a dissolved content of 0.05 to 2 gm/liter of water-soluble calcium-binding sequestrants from the class of pyro, tri-, poly- and metaphosphates, polycarboxylic acids, hydroxycarboxylic acids, aminocarboxylic acids, carboxyalkyl ethers, and polyanionic, polymeric carboxylic and polymeric phosphonic acids, and that the solution is conducted continuously or intermittently by means of a ring conduit (i.e., a by-pass conduit) over a filter or other device suitable for separating the cation exchanger from the washing and cleaning solution, the amount of the cation exchanger being so selected that the residual hardness of the washing and cleaning solution is 0.5 to 20 mg CaO/-liter or less, and alternatively is sufficient to decrease the calcium hardness of the solution by about half, so as to render the process economical.

The water-insoluble cation exchange polymers suitable for carrying out the method are known. These are, for example, the water-insoluble copolymers of acrylic, methacrylic, crotonic, maleic, fumaric, and itaconic acid with olefinically-polyunsaturated compounds, such as alkadienes, dialkenylbenzenes, dialkenyl ethers, dialkenyloxy-alkanes and esters of unsaturated acids with polyols, as they are described, for example, in published German Patent Application DOS 2,411,466, which corresponds to U.S. Patent application Ser. No. 446,153, now abandoned.

They can be present, for example, in the form of swellable particles or as open-pored foams, sponges or fleeces. A variety of suitable materials of this type are disclosed in published German Patent Applications DOS 2,216,467 and DOS 2,307,923. Also suitable are graft polymers of olefinically-unsaturated carboxylic acids, such as the above acids, onto natural or synthetic fibers, e.g., grafts of acrylic acid or methacrylic acid on cellulose. Methods for making these grafts are shown in U.S. Pat. No. 3,721,627 and German Application DOS 2,330,026. These can also be made by the known ceric ion graft polymerization method. The water-insoluble cation exchange polymers can be present in the form of their alkali metal salts, particularly as sodium salt, also as their lithium or potassium salts, or ammonium salts, as well as salts of organic ammonium bases, for example, alkylolamines having 2 to 3 carbons in each alkylol, such as mono-, di-, or triethanolamine, or in the form of the free acids.

The amount of water-insoluble cation exchange polymer should be so selected that the residual hardness of the cleaning solution attains in the course of the washing process a value of 0.5 to 20 mg CaO/liter. Otherwise stated, the amount normally used is that which decreases the hardness of the water by at least about 50%, which is about the least amount needed to render the process economical.

If the water-insoluble cation exchange polymer is present in granular or powdered form, it is advisable to select the particle size so that the particles are larger than 20μ, in order to achieve a good filtering effect. The upper limit of the particle size is determined only by the penetrability of the exchange material and the dimensions of the filter or other separatory device. When sufficiently porous, the water-insoluble cation exchange polymer can also be present in macro form, for example, as a sponge or fleece or as cotton wadding. Finally, the material can be shaped in the form of a filter cartridge, a filter plate or a filter cloth, so that the use of a special filter material is not necessary.

The process of the invention can be performed in a conventional machine washer which comprises in combination a tub adapted to contain the objects to be washed, a conduit having a pump therein adapted to circulate washing solution from one portion of said tub to another portion of said tub, and a vessel in said conduit adapted to contain said ion-exchange agent having a swollen particle size excess of 20μ. The vessel may be a static bed filter or a filter of the fluid bed type, containing the ion exchanger in one of the forms described above. The vessel is hereinafter sometimes for convenience termed a "filter", but it will be understood that in each instance it also performs the function of binding the ions which cause hardness in water.

A method of improving the filtering capacity of the ion exchanger, if desired, consists in using filter aids, like Kieselguhr (silica), diatomaceous earth, pumice powder, cellulose, or finely ground plastic foam. The ion exchanger can also be deposited or adsorbed on these porous materials, improving the filtering capacity during the production or after in order to increase this way the particle size.

Clogging of the filter when using ion exchangers can also be prevented and at the same time the washing process can be accelerated and the cleaning result improved and the exchanger capacity better utilized by keeping the ion exchanger constantly in motion inside the filter, for example, by recycling the cleaning solution intermittently or repeatedly, and by reversing its direction of flow during the washing process. Preferably a so-called "whirlpool bed filter" is used for the purpose where the turbulence of the filter contents (the ion-exchange copolymer in particulate form) is increased by suitable design of the filter, the filter vessel, or of the feed lines.

The process of the present invention is ordinarily used with waters which have a normal hardness in excess of 80 mg of CaO equivalent per liter, i.e., with waters which have an initial hardness of the amount or which develop this hardness as the washing proceeds.

The amount of ion exchanger required to obtain a good washing or cleaning effect depends, on the one hand, on its calcium binding power, and on the other hand, on the amount of dirt in the materials to be washed and on the hardness and the amount of water used. The amount of ion exchanger should be so determined that the residual hardness of the water, before addition of the detergents, does not exceed 7° dH (German hardness; corresponding to 70 mg CaO/liter), preferably 5° to 3° dH (50 to 30 mg CaO/liter). In order to obtain an optimum washing or cleaning effect, it is advisable to use a certain excess of ion exchanger, particularly in the case of greatly soiled substrates, in order to completely or partly bind the hardness formers contained in the released dirt.

A water-soluble substance is added to the aqueous solution of detergent which exerts a sequestering (i.e., a complex-forming) and/or precipitating effect on the calcium obtained in th soil and water hardness.

Suitable as sequestering agents for calcium for the purposes of the invention are also substances with such a low sequestering power that they were not considered heretofore as typical sequestering agents for calcium, but these compounds are frequently capable of delaying the precipitation of calcium carbonate from aqueous solutions. The sequestrants or precipitants binding calcium ions can be present in substoichiometric amounts, related to the hardness formers present. They act as "carriers", that is, their calcium salts are transformed into soluble salts by contact with the ion-exchanger and they are thus again available as sequestrants.

Preferably small amounts of sequestrants or precipitants for calcium are used, e.g., 0.05 to 2 gm/liter in order to speed up or improve the removal of impurities. Particularly, amounts of 0.1 to 1 gm/liter are used. Substantially larger amounts can also be used, but in the case of phosphorus-containing sequestrants or precipitants the amounts should be so selected that the phosphorus load of the waste water is less than with the use of the customary detergents based on triphosphate.

The sequestrants or precipitants comprise those of an inorganic nature such as the water-soluble alkali metal (particularly the sodium) and ammonium pyrophosphates, triphosphates, higher polyphosphates, and metaphosphates.

Organic compounds which act as sequestrants or precipitants for calcium include the water-soluble polycarboxylic acids, hydroxycarboxylic acids, aminocarboxylic acids, carboxyalkyl ethers, polyanionic polymers and water-soluble salts thereof, particularly the polymeric carboxylic acids and the phosphonic acids, which are used as acids, alkali metal or aluminum salts and preferably as sodium salts.

Examples of polycarboxylic acids are dicarboxylic acids of the general formula $$HOOC-(CH_2)_n-COOH$$

wherein $n = 0$ to 8, in addition, maleic acid, methylenemalonic acid, citraconic acid, mesaconic acid, itaconic acid, acyclic polycarboxylic acids with at least three carboxyl groups in the molecule, such as, for example, tricarballylic acid, aconitic acid, ethylene tetracarboxylic acid, 1,1,3,3-propanetetracarboxylic acid, 1,1,3,3,5,5-pentanehexacarboxylic acid, hexanehexacarboxylic acid, cyclic di- or polycarboxylic acids, such as, for example, cyclopentanetetracarboxylic acid, cyclohexanehexacarboxylic acid, tetrahydrofurantetracarboxylic acid, phthalic acid, terephthalic acid, benzene-tri-, tetra- or pentacarboxylic acid, as well as mellitic acid.

Examples of hydroxymono- or polycarboxylic acids are glycolic acid, lactic acid, malic acid, tartronic acid, methyl tartronic acid, gluconic acid, glyceric acid, citric acid, tartaric acid, and salicylic acid.

Examples of aminocarboxylic acids are glycine, glycolglycine, alanine, asparagine, glutamic acid, aminobenzoic acid, iminodi- or triacetic acid, (hydroxyethyl-)iminodiacetic acid, ethylenediaminetetraacetic acid, (hydroxyethyl)-ethylenediaminetriacetic acid, diethylenetriaminepentaacetic acid, as well as higher homologues, which can be obtained by polymerization of an N-aziridylcarboxylic acid derivative, e.g., acetic acid, succinic acid, tricarballylic acid and subsequent saponification or by condensation of polyimines with a molecular weight of 500 to 10,000 with salts of chloroacetic or bromoacetic acid.

Examples of carboxyalkyl ethers are 2,2-oxydisuccinic acid and other ether polycarboxylic acids, particularly polycarboxylic acids containing carboxymethyl ether groups which comprise corresponding derivatives of the following polyvalent alcohols or hydroxycarboxylic acids, which can be completely or partly etherified with the glycolic acid:

glycol
di- or triglycols
glycerin
di- or triglycerin
glycerin monomethyl ether
2,2-dihydroxymethyl-propanol
(1,1,1-trihydroxymethyl)-ethane
(1,1,1-trihydroxymethyl)-propane
erythrite
pentaerythrite
glycolic acid
lactic acid
tartronic acid
methyltartronic acid
tartaric acid
trihydroxy glutaric acid
saccharic acid
mucic acid.

As transition types to the polymeric carboxylic acids are the carboxymethyl ethers of sugar, starch and cellulose.

Among the polymeric carboxylic acids, the polymers of acrylic acid, hydroxyacrylic acid, maleic acid, itaconic acid, mesaconic acid, aconitic acid, methylene malonic acid, citraconic acid, etc., the copolymers of the above-mentioned carboxylic acids with each other or with ethylenically unsaturated compounds, such as ethylene, propylene, isobutylene, vinyl alcohol, vinyl methyl ether, furan, acrolein, vinyl acetate, acrylamide, acrylonitrile, methacrylic acid, crotonic acid, etc., such as the 1:1 copolymers of maleic acid anhydride and ethylene or propylene or furan, play a special role.

Other polymeric carboxylic acids of the type of the polyhydroxypolycarboxylic acids or polyaldehydopolycarboxylic acids are substantially substances composed of acrylic acid and acrolein units or acrylic acid and vinyl alcohol units which can be obtained by copolymerization of acrylic acid and acrolein or by polymerization of acrolein and subsequent Cannizzaro reaction, if necessary, in the presence of formaldehyde.

Examples of phosphorus-containing organic sequestrants are alkane-polyphosphonic acid, amine- and hydroxyalkane polyphosphonic acids and phosphono-carboxylic acids, such as:

methane diphosphonic acid
propane-1,2,3-triphosphonic acid
butane-1,2,3,4-tetraphosphonic acid,
polyvinyl phosphonic acid
1-amino-ethane-1,1-diphosphonic acid
1-amino-1-phenyl-1,1-diphosphonic acid
aminotrimethylene phosphonic acid
methylamine- or ethylamine-dimethylene phosphonic acid
ethylene-diaminetetramethylene phosphonic acid 1-hydroxyethane-1,1-diphosphonic acid
phosphonoacetic acid
phosphonopropionic acid
1-phosphonoethane-1,2-dicarboxylic acid
2-phosphonopropane-2,3-dicarboxylic acid
2-phosphonobutane-1,2,4-tricarboxylic acid
2-phosphonobutane-2,3,4-tricarboxylic acid,
as well as copolymers of vinyl phosphonic acid and acrylic acid.

The process of the present invention permits a reduction in the use of phosphorus containing inorganic or organic sequestrants or precipitants to a content of inorganically or organically combined phosphorus in the treatment liquors to less than 0.6 gm/liter, and preferably to less than 0.3 gm/liter, or the working of the process completely without phosphorus-containing compounds.

The process of the present invention is usefully applied to waters of any given objectionable level of hardness.

Apart from washing textiles, which is the preferred field of application, the method and the device according to the invention are also suitable for any other cleaning operations where it is possible or of advantage to return or regenerate the tap water or the cleaning solution. These applications comprise the cleaning of instruments, apparatus, pipe lines, boilers and vessels of any material, such as glass, ceramic material, enamel, metal or plastic. An example is the industrial cleaning of bottles, drums and tank cars. The method is also particularly suitable for use in commercial or household dishwashing machines.

Depending on the use, customary surfactants, builder substances which increase the cleaning power, bleaching agents, as well as compounds which stabilize or activate such bleaching agents, soli-suspension agents or greying inhibitors, optical brighteners, biocides or bacteriostatic substances, enzymes, foam inhibitors, corrosion inhibitors and substances regulating the pH value of the solution can be present in the washing and cleaning process. Such substances, which are normally present in varying amounts in the washing, rinsing and cleaning agents, are listed specifically in Ser. No. 458,306.

When using one or more of the above-mentioned substances which are generally present in cleaning liquors, the following concentrations are preferably maintained:

| Grams per liter | |
|---|---|
| 0.01 to 2.5 | surfactants |
| 0.05 to 2 | sequestrants |
| 0 to 3 | other builder substances |
| 0 to 0.4 | active oxygen or equivalent amounts of active chlorine. |

The pH of the treatment liquors can range from 6 to 13, depending on the substrate to be washed or cleaned; preferably it is between 8.5 and 12.

The treatment temperature can vary within wide limits and is between 20° C. and 100° C. Since the washing and cleaning effect is already very high at low temperatures, that is, between 30° C. and 40° C., and exceeds that of conventional detergents and methods, it is possible to wash very delicate fabrics in this range, e.g., those of wool or silk or very fine porcelain dishes with a very delicate overglaze or gold trim without damaging them.

The washing or cleaning time at the anticipated treatment temperature depends on the degree of soiling, the exchange rate, and the output of the pump. It can, therefore, vary within wide limits, for example, from five minutes or two hours. Preferably, it is between 10 and 60 minutes as this is usually sufficient to effect substantially complete removal of soil. The output of the pump and of the filter are preferably so selected that the cleaning solution is circulated at least twice during the washing period. The washing solution should pass at least five times and preferably ten to about fifty times through the filter charged with the ion exchanger. This output should also be achieved if the filter becomes partially clogged by the deposited material and has become difficult to penetrate.

It is, therefore, advisable to use pumps which still assure a sufficient output at a certain back-pressure, e.g., of 1 to 2 atmospheres above normal. Of advantage are filter arrangements where the trapped solids (including the ion exchanger) are intensively whirled up so that there are no major deposits on the filters during the washing process. Such an arrangement ("whirlpool bed") unlike a fixed bed arrangement of the exchanger, permits shorter washing times and thus the use of smaller and constructionally less elaborate pumps. This effect can be further increased by intermittent operation or reversal of the direction of flow.

The pore size of the filter depends on the particle size of the ion exchanger. Since the deposited material or the additionally used filter aid have also a filter effect, the pore size can be greater than corresponds to the particle size of the fine portions in the interest of a lower flow resistance. With a mean particle size of the ion exchanger of 10 to 50$\mu$, the pore size of the filter can, therefore, be 50 to 150$\mu$, for example, preferably 80 to 120$\mu$, which also applies to the case where the particle size is relatively wide.

The filter element in the device containing the ion-exchanger material can consist of any material, for example, paper, textile fabric, ceramic material, or ion-exchange material itself. To advantage are used paper filters which are discarded together with the deposited ion-exchange material as well as mechanical impurities and lint, or in dishwashing machines food remnants removed from the substrate or retained by the filter. The advantage is that new ion-exchange material with a reproducible activity is used for each cleaning process. Neither the ion exhanger nor the filter material as "pollution-free" garbage represents a burden for the garbage dumps and incinerators.

On the other hand, the ion-exchange material can be regenerated, which may be suitable for lumpy or shaped exchangers. Regeneration, when employed, is preferably effected with highly concentrated common salt solutions. Regeneration can also be effected with solutions of the above-mentioned sequestrants but this is less advisable because of cost and because of the possible pollution of sewage by the spent solution.

The device (i.e., the apparatus) according to the invention consists at least of the following components:

(a) A washing or cleaning unit or dishwashing unit which may be of a conventional or modified construction,
(b) A cycle system equipped with a circulating pump,
(c) At least one adsorption device, such as a filter unit in the cycle system for containing the calcium binding agent.

Moreover, the following arrangements have proved successful for the practice of the process of the invention:

(d) A fresh water inlet, connected with the adsorption device, and
(e) A feeding or proportioning device for the washing and cleaning agent, disposed in the cycle system.

The invention is further illustrated by the drawings wherein:

FIGS. I, II and III are flow diagrams of processes according to the present invention;

FIGS. IV and V show schematically in section a fixed bed and a fluid bed filter suitable for use in the process of the invention;

FIG. VI shows schematically an elevation of a machine clothes washer according to the present invention, and FIG. VII shows a vertical section of another machine clothes washer according to the present invention.

In the Figures, the same numbers designate similar or equivalent components.

In FIG. I the apparatus consists of washing or cleaning unit 1 equipped with valved make-up water inlet 2, valved outlet 3, for discharge of the washing solution, and cycle conduit 4, circulating pump 5, and vessel 6 for containing the calcium binding agent, as well as a washing and cleaning agent feed means 7 connected to the cycle conduit 4.

FIG. II illustrates a modification of the apparatus of FIG. I where the bulk of the circulated cleaning liquid is by-passed around the calcium binding agent vessel 6 and is thus returned directly into the cleaning unit. For this purpose cycle conduit 4 is provided with three-way valve 8 and by-pass conduit 9 which thus permits part or virtually all of the wash water to be circulated through or around the vessel containing the calcium binder. This arrangement is provided for those cleaning units where the mechanical treatment of the material to be cleaned is effected by the circulating cleaning liquor by means of stationary or movable spray nozzles, as is customary, for example, in dishwashing machines or in washing apparatus with suspended textiles. A filter arranged in the main cycling current would offer in these cases a too high resistance to the flow of the cleaning liquor. Valve 8 can be operated intermittently if desired. In continuous washing or spraying plants, it is also possible to arrange two or more ion exchangers, which are equipped with shut-off and draining devices. The filter with exhausted exchangers can then be replaced without having to interrupt the cleaning process.

FIG. III shows a modification of the apparatus of FIG. I to permit the cleaning solution in whole or in part to be stored for further use in the process. For this purpose a storage tank 10 is provided which is connected to cycle conduit 4 by a valved feed line 11 and a return valved line 12. A portion of the rinse water, for example, from the last rinse cycle, can be pumped via line 11 into the tank 10 and be tapped therefrom as needed and fed via the return line 12 into the cycle conduit 4 and the adsorption device or vessel 6 into the washing unit 1.

FIG. IV shows a vessel 6 containing the calcium ion binder in the form of a fixed bed suitable for use as calcium ion binder vessel 6 in FIGS. I, II and III. In FIG. IV, the vessel comprises porous retaining plate 10, filter aid 11 and deposited aluminosilicate 12.

FIG. V shows a vessel 6 for retaining the calcium binder in fluid bed form, which usually provides better results. In FIG. V, the vessel 6 comprises two-part housing having bottom 13, cover 14, sealing ring 15 and pressure screw 16. In operation, the wash liquor, the path of which is marked by arrows (unfiltered solid, filtered dashed lines), enters the vessel through inlet 17, vigorous turbulence being ensured by a suitable (for example, tangential) arrangement of the inlet. After passing through container bag 18, which can consist of paper or textile material, and perforated container 19, the liquor arrives in the outer jacket of the housing and flows from there into outlet connection 20. The vessel can be emptied and cleaned in a simple manner after bag 18 has been removed.

FIG. VI illustrates one form of apparatus suitable for performing the examples. The apparatus is a modified home laundry washing machine. In the machine, fresh water from inlet 2 flows through conduit 4, and circulating pump 5 discharges through conduit 4 to flowmeter 21, three-way sampling valve 23 and calcium binder vessel 6. Conduit 4 is provided with manometer 22 which permits the back-pressure in the system to be determined. Sampling valve 23 permits the condition of the wash water to be observed during the washing process. For example, the degree of clouding or contamination of the treated washing solution can be determined.

FIG. VII illustrates another form of laundry machine washer, suitable for performing the examples. The apparatus here comprises a tub washing machine comprising tank 24, laundry basket 25, and beater cross 26 for mechanically agitating the wash. Basket 25 and cross 26 are driven through reversing gear 27 by motor 28. The same gear also drives circulatory pump 29. The fresh water from fresh water inlet 2 and the circulated washing solution flows from the tank into ring conduit 30 to pump 29 and from there into vessel 31 for containing the calcium ion binder back into the tank. After the completion of the washing process, the washing solution is discharged through outlet 32 after reversing the pump, the non-return valve 33 being closed to prevent the washing solution from flowing back into the tank.

The invention is not limited to the arrangement represented here. Rather these can be supplemented and modified in many ways.

The invention is further illustrated by the examples which follow. These examples are illustrative of the process of the invention. However, they are not to be construed as limitations thereof.

EXAMPLES

The following water-insoluble cation exchange polymers were employed in the examples:

I. An exchanger in the form of sodium salt, obtained by copolymerizing 95 mol % of acrylic acid and 5 mol % of hexamethylene-bis-acrylamide, with a capacity of 8.2 mVal/gm. The resin had a mean particle size (unswollen) of 0.05 mm and of about 0.15 mm when swollen in water.

II. A polyacrylate exchanger (Na salt) prepared according to Example 2 of German DOS 2,411,466 in the form of a finely ground open-pored foam with a particle size of 0.1 mm (unswollen) and a cation binding capacity of 10.5 mVal/gm.

EXAMPLES 1 to 6

The following illustrates the washing of a variety of fabrics carrying a standard soil (including iron soil) in water having a high concentration of calcium hardness components and containing anionic detergents. The washing was performed in a commercial drum washing machine (of the Lavamat SL type) with a horizontally mounted drum modified as shown in FIG. VI, where the ion-exchange vessel corresponds to that of FIG. V.

The cation exchanger employed was prepared according to I above by the copolymerization of 94 mol % of acrylic acid and 6 mol % of hexamethylene-bis-acrylamide and had a capacity of 8.2 mVal/gm and an average particle size of 0.05 mm (dry) or about 0.15 to 0.2 mm (swollen in water). The water-insoluble cation exchange copolymer was placed in the filter together with 10% by weight of diatomaceous earth serving as filtering aid. Then the washing machine was charged with 3 kg of clean fill-up laundry as well as two textile samples each (20 × 20 cm) of cottom (C), finished cotton (F.C.) and a blend of 50% polyester and 50% finished cotton (P/C). The textile samples were artificially soiled with skin fat, kaolin, iron oxide black and carbon black; this simulates the soil of naturally soiled garments.

The admitted tap water (quantity 20 liters, hardness 16° dH, 160 mg CaO/liter) was passed through valved line 2 to and through the filter 6 charged with ion exchanger immediately on being let in and then circulated for another ten minutes with agitation of the laundry. At this point, the hardness was less than 35° dH. Subsequently, the washing agent was added and the wash liquor was heated to 90° C. for the cotton and finished cotton and to 60° C. for the blended fiber.

During the 40 minute washing period, the wash liquor was circulated with a throughput of 12 liters/minute and the pumping was interrupted every five minutes for a few seconds to loosen the filter content by the resulting back pressure and thus to prevent clogging of the filter.

The following washing agent components and additives in grams per liter of wash liquor were employed:

| WASHING AGENT A | |
|---|---|
| Grams/liter | |
| 0.5 | Na n-dodecylbenzene sulfonate |
| 0.17 | Ethoxylated tallow fatty alcohol (14 mols ethylene oxide) |
| 0.27 | Na soap (tallow fatty acids/ behenic acid 1:1) |
| 0.015 | Na ethylenediaminetetraacetate (EDTA) |
| 0.25 | Na silicate ($Na_2$:$SiO_2$ = 1:3.3) |
| 0.11 | Na carboxymethylcellulose (Na CMC) |
| 2.0 | Sodium perborate tetrahydrate |
| 0.2 | Magnesium silicate |
| 0.2 | Sodium sulfate. |

| WASHING AGENT B | |
|---|---|
| Grams/liter | |
| 0.5 | Ethoxylated oxoalcohol $C_{14}$-$C_{17}$ (12 mols ethylene oxide) |
| 0.17 | Ethoxylated tallow fatty alcohol (5 mols ethylene oxide) |
| 0.27 | Na soap (tallow fatty acids/ behenic acid 1:1) |
| 0.015 | Na ethylenediaminetetraacetate (EDTA) |
| 0.25 | Na silicate ($Na_2$:$SiO_2$ = 1:3.3) |
| 0.11 | Na carboxymethylcellulose (Na CMC) |
| 2.0 | Sodium perborate tetrahydrate |
| 0.2 | Magnesium silicate |

-continued

| WASHING AGENT B | |
|---|---|
| 0.2 | Sodium sulfate |

The other additives are given in Table 1. The abbreviation Na TPP stands for sodium tripolyphosphate. In the column "Presoftening", the symbol (+) stands for the procedure according to the invention, while in the comparison tests (−) the fresh water was not softened before addition of washing agent.

After termination of the washing process and pumping off of the wash solution, the cleaned goods were rinsed with tap water four times and ended by spinning to dryness. The percentual remission valves of the textile samples, determined photometrically, are compiled in the following Table 1. They show that by the presoftening, the cleaning result can still be improved as compared with the results of Ser. Nos. 639,465 and 821,968.

TABLE 1

| Example | Washing Agent | Exchanger gm/liter | Additives gm/liter | Pre-softening | % Remission C | F.C. | P/C |
|---|---|---|---|---|---|---|---|
| — | A | — | — | − | 55 | 57 | 52 |
| — | A | 2.5 | 0.4 Na TPP | − | 80 | 70 | 55 |
| — | A | 2.5 | 0.4 Na citrate | − | 80 | 70 | 56 |
| — | A | 2.5 | 0.4 Na TPP 0.4 Na citrate | − | 82 | 73 | 56 |
| 1 | A | 2.5 | 0.4 Na TPP | + | 82 | 73 | 71 |
| 2 | A | 2.5 | 0.4 Na citrate | + | 82 | 73 | 71 |
| 3 | A | 2.5 | 0.4 Na TPP 0.4 Na citrate | + | 83 | 74 | 72 |
| — | B | — | — | − | 79 | 68 | 60 |
| — | B | 2.5 | 0.4 Na TPP | − | 82 | 73 | 74 |
| — | B | 2.5 | 0.4 Na citrate | − | 82 | 75 | 73 |
| — | B | 2.5 | 0.4 Na TPP 0.4 Na citrate | − | 82 | 76 | 75 |
| 4 | B | 2.5 | 0.4 Na TPP | + | 83 | 77 | 77 |
| 5 | B | 2.5 | 0.4 Na citrate | + | 83 | 77 | 77 |
| 6 | B | 2.5 | 0.4 Na TPP 0.4 Na citrate | + | 83 | 78 | 78 |

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A method for machine washing and cleaning of solid materials utilizing washing and cleaning solutions in the presence of water-insoluble cation exchange agents which are capable of binding the hardness components of the water and the soil, comprising withdrawing and recycling the tap water having a hardness of more than 80 mg CaO/liter in contact with said solid soiled materials through a water-insoluble cation exchange copolymer in particulate state having a swelled average particle diameter in excess of 20μ and having a calcium binding power of at least 2 mVal/gm, said copolymer being a copolymer or graft polymer derived from monoolefinically-unsaturated carboxylic acids, said cation exchange copolymer being maintained out of contact with said solid soiled materials in a separate area from the washing area, for such time until the water has a hardness of not more than 70 mg CaO/liter, then adding other soluble washing and cleaning compounds including between 0.5 gm/liter and 2 gm/liter of a water-soluble calcium-binding sequestrant and customary surface-active compounds selected from the group consisting of an anionic surface-active compound, a nonionic surface-active compound and mixtures thereof to said softened tap water and washing said solid materials while continuing the recycling of the wash solution through said cation exchange copolymer, wherein the total amount of washing solution is continuously or intermittently cyclically circulated from the washing area through the separate area with the cation exchange copolymer and then back to the washing area at least five times during the cleaning process, and where the amount of the cation exchange copolymer is so selected that the residual hardness of the filtered washing solution is less than 20 mg CaO/-liter.

2. The process of claim 1 wherein said tap water is recycled until the water has a hardness of less than 50 mg CaO/liter.

3. The process of claim 1 wherein said tap water is recycled until the water has a hardness of less than 30 mg CaO/liter.

4. The process of claim 1 wherein said solid soiled-materials are textiles.

5. The process of claim 1 wherein said cation exchange copolymer is maintained out of contact with said solid soiled materials in a separate area from the washing area by a filter means.

6. The process of claim 5 wherein said filter means is a static bed filter means.

7. The process of claim 5 wherein said filter means is a fluidized bed filter means.

8. The process of claim 1 wherein said water-insoluble cation exchange copolymer has a calcium binding capacity in excess of 8 mVal/gm.

9. The process of claim 1 wherein said other soluble washing and cleaning compounds include an anionic surface-active compound.

* * * * *